United States Patent [19]

Grunke et al.

[11] Patent Number: 4,935,193

[45] Date of Patent: Jun. 19, 1990

[54] METHOD FOR PRODUCING A LAYER PROTECTIVE AGAINST OXIDATION

[75] Inventors: Richard Grunke, Munich; Lothar Peichl, Dachau; Heinrich Walter, Friedberg, all of Fed. Rep. of Germany

[73] Assignee: MTU Motoren-und Turbinen-Union Muenchen GmbH, Munich, Fed. Rep. of Germany

[21] Appl. No.: 283,745

[22] Filed: Dec. 13, 1988

[30] Foreign Application Priority Data

Dec. 18, 1987 [DE] Fed. Rep. of Germany ..... 3742944

[51] Int. Cl.[5] ..... C23C 10/06; C23C 10/34; C23C 10/48

[52] U.S. Cl. ..... 427/12; 427/250; 427/328; 427/367; 427/398.4; 427/405; 427/436; 148/6; 148/13.1; 148/421; 148/DIG. 33; 148/269; 420/418; 204/38.1; 419/8; 419/46

[58] Field of Search ..... 148/421, 437, 6, 13.1, 148/DIG. 30, DIG. 33; 427/250, 328, 367, 398.4, 405, 436; 420/418; 204/38.1

[56] References Cited

U.S. PATENT DOCUMENTS

| | | | |
|---|---|---|---|
| 2,918,367 | 12/1959 | Crossley | 148/437 |
| 3,594,219 | 7/1971 | Maxwell | 427/405 |
| 3,967,983 | 7/1976 | Chia | 148/437 |
| 4,080,223 | 3/1978 | Schoerner | 148/437 |
| 4,684,414 | 8/1987 | Masumoto | 148/437 |

FOREIGN PATENT DOCUMENTS 1202619 8/1970 United Kingdom .

OTHER PUBLICATIONS

Oxidation of Aluminide Coatings on Unalloyed Titanium; Streiff et al.

*Primary Examiner*—Jay H. Woo
*Assistant Examiner*—Jeremiah F. Durkin, II
*Attorney, Agent, or Firm*—W. G. Fasse; D. H. Kane, Jr.

[57] ABSTRACT

The quality or durability of an oxidation protective coating produced by alitizing or aluminizing on the surface of a structural component made of titanium or titanium alloy, is improved by adding niobium to the surface of the structural component. The addition may be accomplished prior to the aluminizing or during the aluminizing. Prior application may involve, for example, vapor deposition of the niobium. Simultaneous application involves including a niobium donator powder in the aluminizing powder mixture.

8 Claims, No Drawings

METHOD FOR PRODUCING A LAYER PROTECTIVE AGAINST OXIDATION

CROSS-REFERENCE TO RELATED APPLICATION

The present application is related to our copending application entitled: "Method for Applying an Aluminum Diffusion Coating to a Component of Titanium Alloy", filed simultaneously with the present application; U.S. filing date Dec. 13, 1988; U.S. Ser. No. 97/283,746.

FIELD OF THE INVENTION

The present invention relates to a method for producing a layer protective against oxidation, especially a protective aluminum diffusion coating applied by aluminizing surface areas of structural components made of titanium alloys. Such aluminizing is accomplished by an aluminum diffusion process and the resulting protective coatings against oxidation are especially useful for structural components exposed to high thermal loads.

BACKGROUND INFORMATION

Titanium and alloys thereof are important construction materials due to their advantageous strength to weight ratio. However, these advantageous characteristics can be used only under temperatures up to about 550° C. At higher temperatures structural components made of titanium or titanium alloys tend to become brittle due to the diffusion of oxygen into areas close to the surface of the structural component. When aluminum is an alloy element in a titanium alloy, the entry of oxygen into the component is delayed. Thus, efforts have been made to introduce aluminum into the surface areas of such structural components in order to form protective coatings. The process of applying such protective coatings involves a diffusion coating known as alitizing or aluminizing and this process has been especially economical.

Conventional methods or layer systems, however, have the following disadvantages. The protective coating formed by alitizing or aluminizing oxidizes at higher temperatures. Of the two metals titanium and aluminum which participate primarily in the formation of the protective layer, the aluminum has a higher affinity to oxygen than titanium. As a result, the surface of aluminized titanium components becomes coated with an aluminum oxide ($Al_2O_3$) which forms under oxidizing operating conditions on the protective layer surface. The resulting aluminum oxide layer has practically no bonding to the titanium aluminum protective layer so that in response to any mechanical loading, the aluminum oxide layer easily flakes off, for example, due to thermal expansion when the component is exposed to temperature changes. As a result, a new aluminum oxide layer is immediately formed on the exposed areas, whereby the aluminum content of the protective layer is continuously diminished or depleted under such oxidizing conditions. When this condition continues, the thickness of the protective layer is reduced and the protection effect is diminished. Further, titanium aluminum protective coatings are brittle so that from a strength point of view such coatings must be produced as thin as possible. On the other end, the using up of the protective coating due the to repeated formation of aluminum oxide layers by oxidation requires thicker protective layers than would normally be necessary.

Another disadvantage of the formation of these aluminum oxide layers and their flaking is seen in that the surface quality of the component is impaired due to a roughness that results from the flaking. Such roughness is undesirable, especially in connection with structural components forming aerodynamic profiles such as compressor blades or vanes because the roughness reduces the efficiency of such blades.

OBJECTS OF THE INVENTION

In view of the above it is the aim of the invention to achieve the following objects singly or in combination:

to provide a method for producing an aluminum coating protective against oxidations of titanium or titanium alloys so that these protective coatings or layers will retain their thickness even under oxidizing operating conditions;

to avoid the above mentioned roughening and flaking due to oxidation of conventional protective layers or to at least diminish such flaking and surface roughening; and to generally improve the durability of oxidation protective coatings on structural components made of titanium or titanium alloys.

SUMMARY OF THE INVENTION

The above objects have been achieved according to the invention by applying niobium in combination with the aluminizing. The application of the niobium may take place prior to the aluminizing step or the two steps may take place simultaneously.

DETAILED DESCRIPTION OF PREFERRED EXAMPLE EMBODIMENTS AND OF THE BEST MODE OF THE INVENTION

In a first example a powder mixture is prepared for use in the subsequent diffusion step. One example of such a powder mixture is as follows.

EXAMPLE: 1

80 weight % $Al_2O_3$ (filler material);
8 weight % Al-Powder (donator material);
8 weight % Nb-Powder (donator material);
4 weight % $AlF_3$ (activator).

The titanium or titanium alloy structural component is embedded in the above powder mixture and introduced into a diffusion oven. The mixture and component are heated to an annealing temperature of 800° C. in an atmosphere of clean or pure argon and that temperature is maintained for about 8 hours. In this first example, the aluminizing and niobium application takes place simultaneously.

EXAMPLE: 2

A layer of niobium having a thickness within the range of about 0.1 μm to about 1 μm is first applied in a preliminary coating step to the surface areas of a titanium or titanium alloy structural component. This niobium layer is applied by vapor deposition under a high vacuum condition, or by a galvanic process, namely electrolytic deposition or by a sputtering process, namely physical vapor deposition. Following the vapor deposition the component is diffusion annealed in a vacuum oven for 2 hours at a temperatures of about 1100° C. In this diffusion annealing the niobium diffuses into the surface of the structural component. In a third operational step the aluminizing is performed, whereby the so prepared structural component is embedded in a powder having the following composition.

88 weight % $Al_2O_3$ (filler material);

8 weight % Al-Powder (donor);

4 weight % $AlF_3$ (activator).

The so embedded component is then heated at a temperature of 800° C. for 8 hours to achieve the aluminizing.

Advantages of the invention are seen in that by diffusing the niobium into the surface zones of the structural component it becomes an integral part of the protective coating together with the titanium and the aluminum. As a result, the use up of the protective coating is substantially reduced, especially under oxidizing operating conditions at temperatures above 550° C. As a result, the so coated structural components can operate for longer periods of time under such high temperature operating conditions than was possible heretofore so that down times for maintenance are substantially reduced and respectively the operating times are increased.

Yet another advantage is seen in the fact that the above mentioned roughening is substantially reduced so that drag losses are lowered which, for example, in connection with turbo blades results in an improved efficiency factor. The thickness of the protective coatings can be reduced which in turn reduces the costs and also increases the mechanical strength or bonding of these layers since the above mentioned flaking is substantially reduced or eliminated. The probability of failure of such structural components treated according to the invention due to use up of the protective layer is also reduced.

As mentioned, the application of the niobium may be accomplished during or prior to the aluminizing operation. As mentioned, a niobium layer having a thickness within the range of about 0.1 μm to about 3 μm is applied to the surface of the structural component prior to the aluminizing. In addition to the above example of vapor deposition, the niobium layer may be applied by galvanizing or sputtering. These methods make it possible to precisely dose the quantity of the required niobium while simultaneously distributing the niobium uniformly onto the surfaces of the structural component.

Where the niobum is applied during the aluminizing, the powder mixture would contain 3 to 15% by weight of niobium. This method is very economical because it does not require any additional method steps for the application of the niobium in addition to the aluminizing step.

Preferably, the niobium could be an alloying component of one of the elements within the powder mixture used for the aluminizing. For example, aluminum could be alloyed with the niobium and the so formed alloy is then used as a powder in the mixture. As a result, the advantage of constant quantity ratios of the niobium to the aluminum is achieved and this constancy of the niobium is uniformly distributed over the structural component surface.

Although the invention has been described with reference to specific example embodiments, it will be appreciated, that it is intended, to cover all modifications and equivalents within the scope of the appended claims.

What we claim is:

1. A method for improving the durability of an oxidation protective coating on a structural component of titanium or titanium base alloy, comprising the following steps:

(a) applying a layer of niobium to a surface of said structural component of titanium or of titanium base alloy, and then (b) aluminizing a surface of said niobium layer.

2. The method of claim 1, wherein said applying of niobium is continued until said niobium layer has a thickness within the range of 0.1 to 3.0 μm.

3. The method of claim 1, wherein said niobium layer is applied by vapor deposition.

4. The method of claim 1, wherein said niobium layer is applied by electrolytic deposition.

5. The method of claim 1, wherein said niobium layer is applied by physical vapor deposition.

6. A method for improving the durability of an oxidation protective coating on a structural component of titanium or titanium base alloy, comprising the following steps:

(a) preparing a powder mixture containing niobium powder and aluminum powder, said niobium powder being present within the range of 3 to 15% by weight of the total powder mixture, the remainder being aluminum powder and an activator, (b) embedding said structural component of titanium or titanium base alloy in said powder mixture, (c) heating the powder mixture with the structural component therein to a temperature and for a time duration sufficient for aluminizing surfaces of said structural component with a diffusion layer of aluminum and niobium.

7. The method of claim 6, wherein said niobium is supplied in the form of an alloying component of an aluminum alloy powder forming said powder mixture.

8. The method of claim 7, wherein said temperature is about 800° C., wherein said time duration is about eight hours, and wherein said heating is performed in an atmosphere of argon.

* * * * *